US007444708B2

(12) United States Patent
Huang

(10) Patent No.: US 7,444,708 B2
(45) Date of Patent: Nov. 4, 2008

(54) SHOE TREE SUPPORTING SHOE EXACTLY

(76) Inventor: Yu-Chun Huang, 21F-10, No. 241, Sec. 3, Wen Hsin Rd., Taichung (TW)

( * ) Notice: Subject to any disclaimer, the term of this patent is extended or adjusted under 35 U.S.C. 154(b) by 286 days.

(21) Appl. No.: 11/301,887

(22) Filed: Dec. 13, 2005

(65) Prior Publication Data

US 2006/0207039 A1 Sep. 21, 2006

(30) Foreign Application Priority Data

Mar. 18, 2005 (TW) ..... 94204224 U

(51) Int. Cl.
*A43D 15/00* (2006.01)

(52) U.S. Cl. ..... 12/114.2; 12/114.6

(58) Field of Classification Search ..... 12/128 R, 12/114.2, 114.6, 128 H, 128 C, 117.2
See application file for complete search history.

(56) References Cited

U.S. PATENT DOCUMENTS 254,150 A * 2/1882 Nichols ..... 12/116.8
1,632,955 A * 6/1927 Witt ..... 12/128 R
1,807,973 A * 6/1931 De Witt ..... 12/128 R
2,004,159 A * 6/1935 De Witt ..... 12/117.2
3,175,237 A * 3/1965 Baas, Sr. ..... 12/116.8
6,202,240 B1 * 3/2001 Tsung-Ping ..... 12/128 R
6,209,161 B1 * 4/2001 Tsung-Ping ..... 12/128 R

* cited by examiner

*Primary Examiner*—Marie Patterson
(74) *Attorney, Agent, or Firm*—Alan Kamrath; Kamrath & Associates PA

(57) ABSTRACT

A shoe tree for one shoe includes a main body having a front end formed with a vamp support portion and a rear end formed with an upwardly extending rising portion and having a first side formed with a first side support portion and a second side formed with a second side support portion. Thus, the first side support portion has a shape matching that of the outer side of the shoe, and the second side support portion has a shape matching that of the inner side of the shoe so that the inner space of the shoe is supported by the main body of the shoe tree rigidly and stably, thereby preventing the shoe from being deformed due to its gravity.

7 Claims, 8 Drawing Sheets

SHOE TREE SUPPORTING SHOE EXACTLY

BACKGROUND OF THE INVENTION

1. Field of the Invention

The present invention relates to a shoe tree and, more particularly, to a shoe tree that is inserted into the inner space of one shoe to support the shoe, thereby preventing the shoe from being deformed due to its gravity.

2. Description of the Related Art

A conventional shoe tree 20 in accordance with the prior art shown in FIG. 7 is made of a paper board which is bent to form an arc-shaped profile. Thus, the shoe tree 20 is inserted into the inner space of one shoe to support the shoe. However, the shape of the shoe tree 20 does not match that of the inner space of the shoe, so that the shoe tree 20 cannot support the shoe exactly, and the shoe is easily deformed due to its gravity. In addition, the shoe tree 20 cannot be removed from the shoe easily and rapidly, thereby greatly causing inconvenience to the user.

Another conventional shoe tree 30 in accordance with the prior art shown in FIGS. 8 and 9 is made of a paper mold having a top 32 whose shape matching that of the vamp 52 of one shoe 50. However, the shape of the bottom 34 of the shoe tree 30 does not match that of the sole 54 of one shoe 50, so that the shoe tree 30 cannot support the shoe 50 exactly, and the shoe 50 is easily deformed due to its gravity. In addition, the shoe tree 30 cannot be removed from the shoe 50 easily and rapidly, thereby greatly causing inconvenience to the user.

Another conventional shoe tree 40 in accordance with the prior art shown in FIGS. 10-12 is made of a paper mold having a top 42 whose shape matching that of the vamp 52 of one shoe 50 and a bottom 44 whose shape matching that of the sole 54 of the shoe 50. The shoe tree 40 has a rear portion provided with a handle 46 to facilitate a user removing the shoe tree 40 from the shoe 50. In design, the sole 54 of the shoe 50 has an inner side and an outer side, wherein the inner side has a protruding flange. Thus, the inner side and the outer side of the sole 54 of the shoe 50 are not arranged symmetrically. However, the bottom 44 of the shoe tree 40 has two arc-shaped side walls 44 that are arranged symmetrically, so that the bottom 44 of the shoe tree 40 cannot fit the sole 54 of the shoe 50 closely. In addition, the handle 46 protrudes from the shoe 50 as shown in FIG. 12, thereby causing inconvenience in package of the shoe 50.

SUMMARY OF THE INVENTION

In accordance with the present invention, there is provided a shoe tree, comprising a main body having a front end formed with a vamp support portion and a rear end formed with an upwardly extending rising portion and having a first side formed with a substantially arc-shaped first side support portion and a second side formed with a substantially arc-shaped second side support portion extending forward relative to the first side support portion.

The primary objective of the present invention is to provide a shoe tree that supports the inner space of one shoe exactly.

Another objective of the present invention is to provide a shoe tree, wherein the first side support portion has a shape matching that of the outer side of the shoe, and the second side support portion has a shape matching that of the inner side of the shoe so as to satisfy the ergonomic design, so that the inner space of the shoe is supported by the main body of the shoe tree rigidly and stably, thereby preventing the shoe from being deformed due to its gravity.

A further objective of the present invention is to provide a shoe tree, wherein the rising portion of the main body has a bottom formed with a hollow portion connected to the inside of the main body to allow insertion of a user's one finger into the inside of the main body, so that the main body is removed from the shoe easily and rapidly, thereby facilitating the user removing the shoe tree from the shoe.

Further benefits and advantages of the present invention will become apparent after a careful reading of the detailed description with appropriate reference to the accompanying drawings.

DETAILED DESCRIPTION OF THE INVENTION

Figure 1:
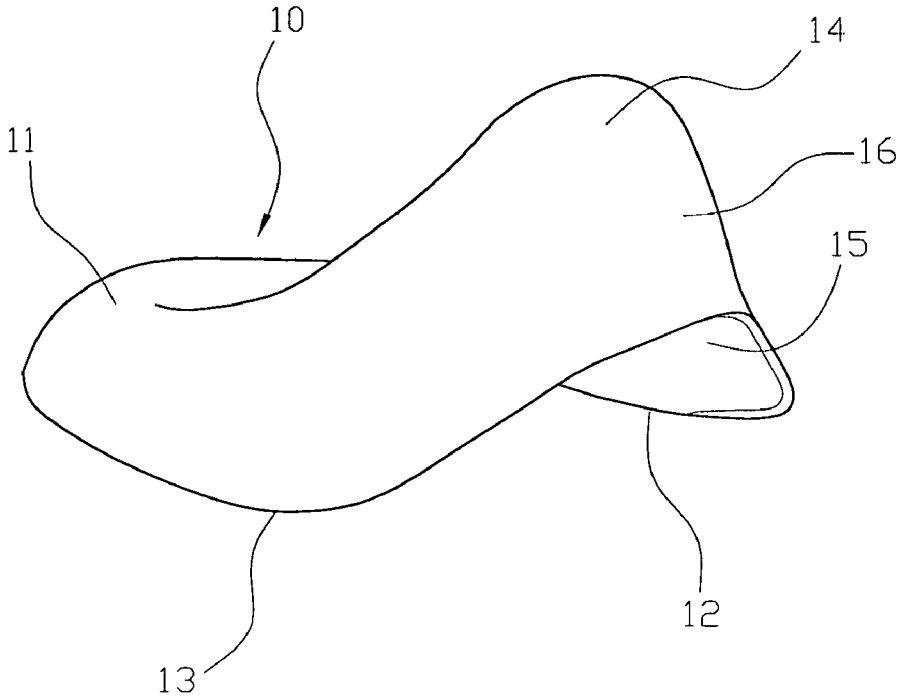
FIG. 1 is a perspective view of a shoe tree in accordance with the preferred embodiment of the present invention.
Figure 2:
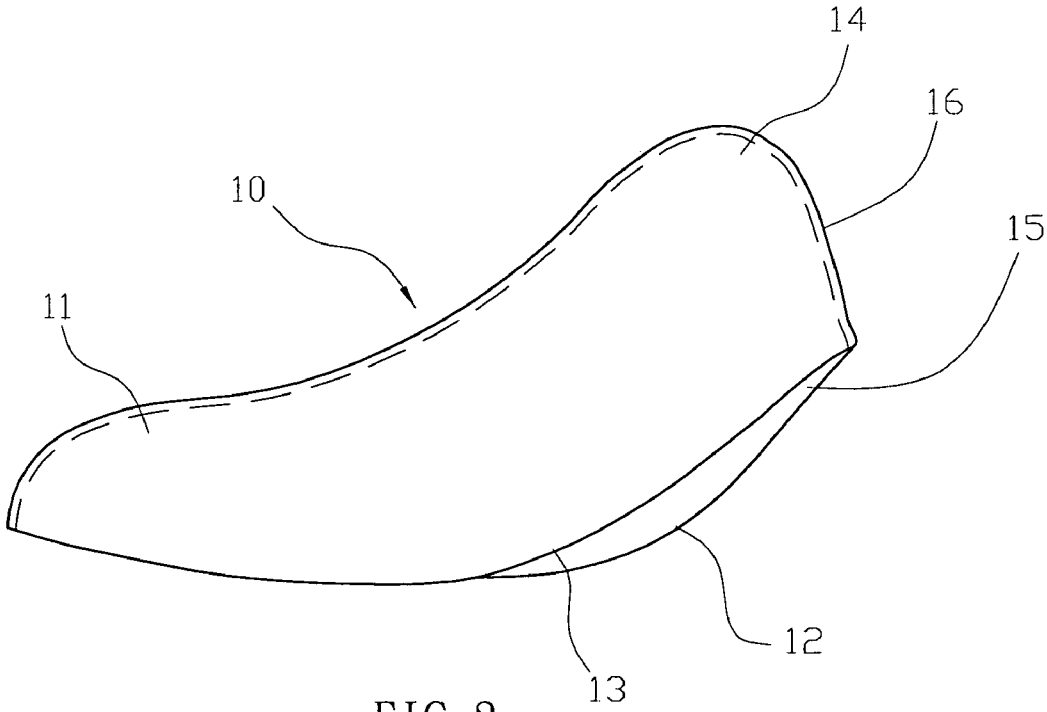
FIG. 2 is a plan view of the shoe tree as shown in FIG. 1.
Figure 3:
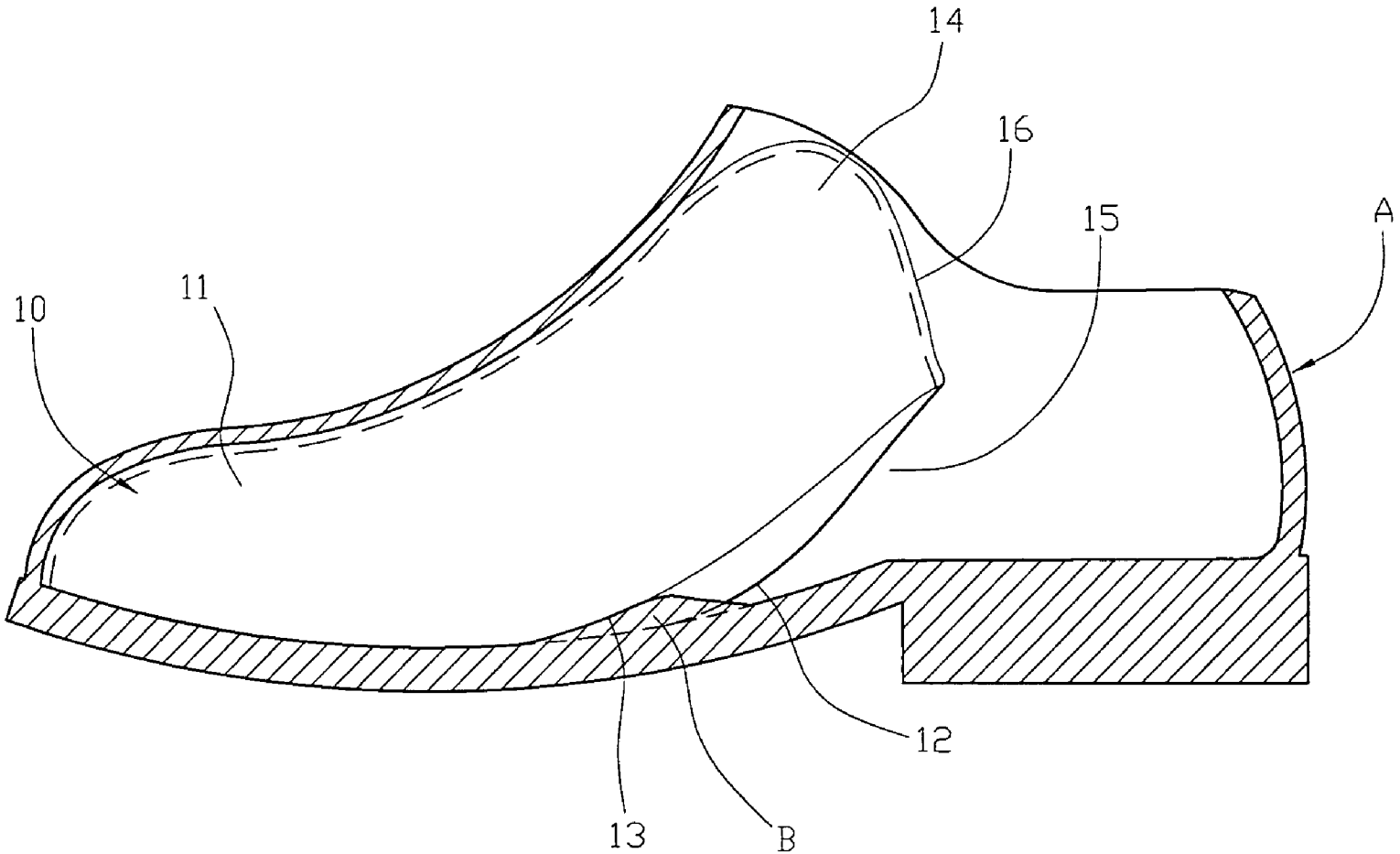
FIG. 3 is a side plan cross-sectional view of the shoe tree for one shoe as shown in FIG. 1.

Referring to the drawings and initially to FIGS. 1-3, a shoe tree in accordance with the preferred embodiment of the present invention comprises a main body 10 having a front end formed with a vamp support portion 11 and a rear end formed with an upwardly extending rising portion 14 and having a first side formed with a substantially arc-shaped first side support portion 12 and a second side formed with a substantially arc-shaped second side support portion 13 extending forward relative to the first side support portion 12.

The main body 10 is a hollow shell shaped element that is formed integrally.

The second side support portion 13 is extended rearward and downward from the vamp support portion 11, and the first side support portion 12 is extended rearward and downward from the vamp support portion 11 and extended to an extent exceeding the second side support portion 13 so that the first side support portion 12 is protruded outward from the second side support portion 13 as shown in FIG. 2.

The rising portion 14 is substantially arc-shaped. The rising portion 14 is extended upward from a curved face of each of the first side support portion 12 and the second side support portion 13. The rising portion 14 has a rear side 16 extended downward and located between the first side support portion 12 and the second side support portion 13.

The rear side 16 of the rising portion 14 has a bottom formed with a hollow portion 15 connected to an inside of the main body 10 to allow insertion of a user's one finger into the inside of the main body 10.

Figure 4:
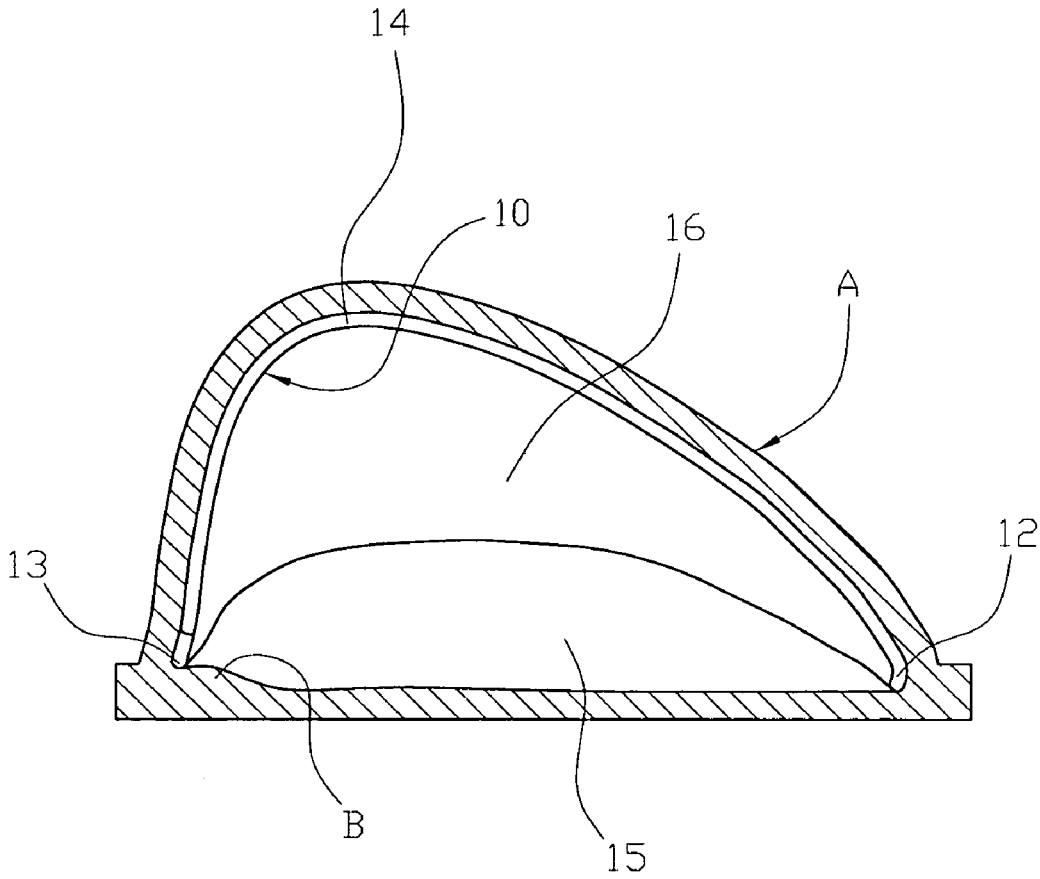
FIG. 4 is a rear plan cross-sectional view of the shoe tree for one shoe as shown in FIG. 1.

When in use, referring to FIGS. 1-4, the main body 10 is placed into the inner space of one shoe to support the shoe "A", thereby preventing the shoe "A" from being deformed due to its gravity. At this time, the vamp support portion 11 is rested on the vamp of the shoe "A" and the rising portion 14 is rested on the throat of the shoe "A" as shown in FIG. 3, while the first side support portion 12 is rested on the outer side of the shoe "A", and the second side support portion 13 is rested on the inner side of the shoe "A" and extended along an inner flange "B" of the inner space of the shoe "A" as shown in FIG. 4. Thus, the shoe "A" is supported by the main body 10 of the shoe tree, thereby preventing the shoe "A" from being deformed due to its gravity.

Figure 5:
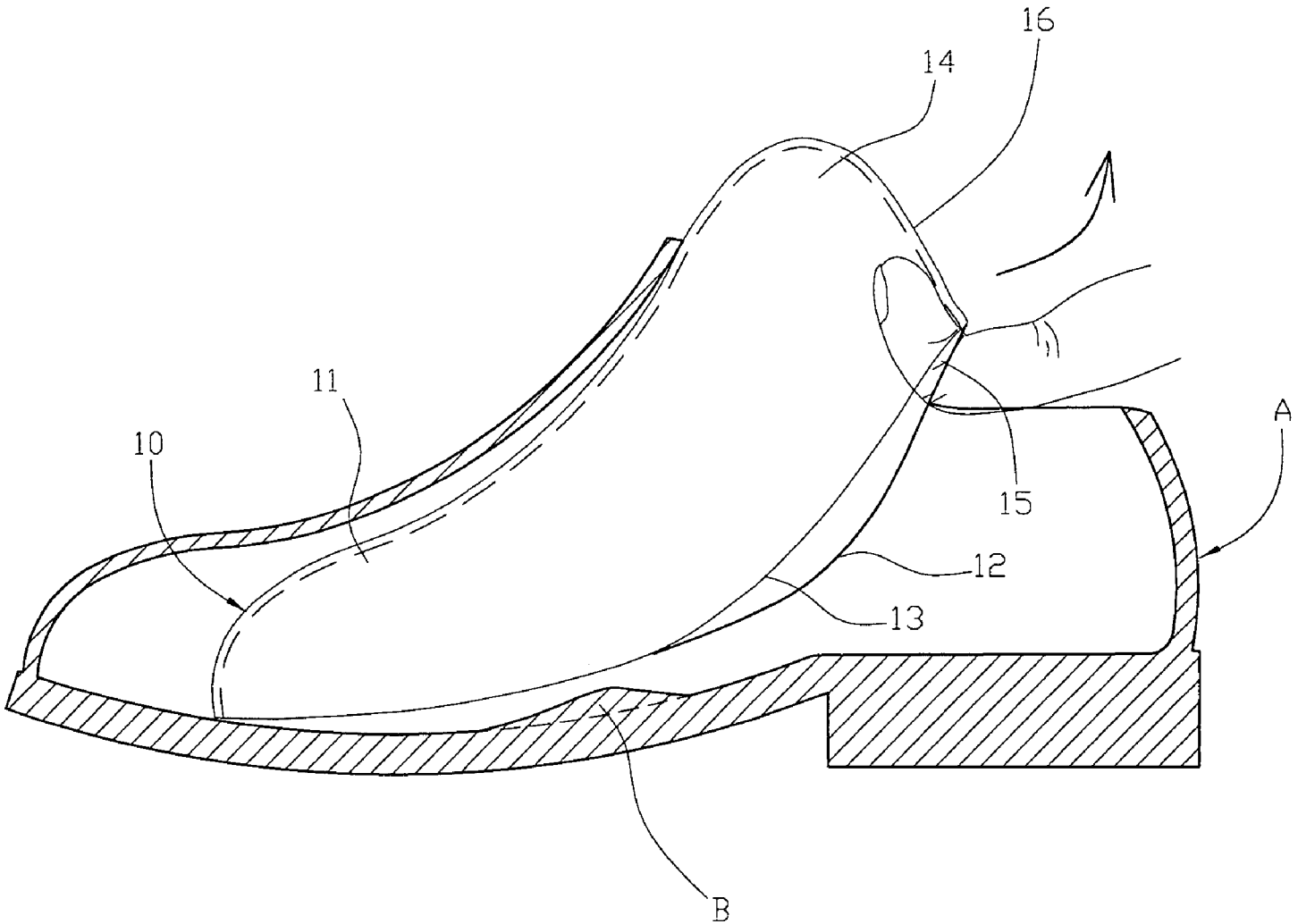
FIG. 5 is a schematic operational view of the shoe tree as shown in FIG. 3.

As shown in FIG. 5, the user's one finger is inserted through the hollow portion 15 of the rising portion 14 into the inside of the main body 10 to pull out the rising portion 14 of the main body 10 so as to remove the shoe tree from the shoe "A".

Figure 6:
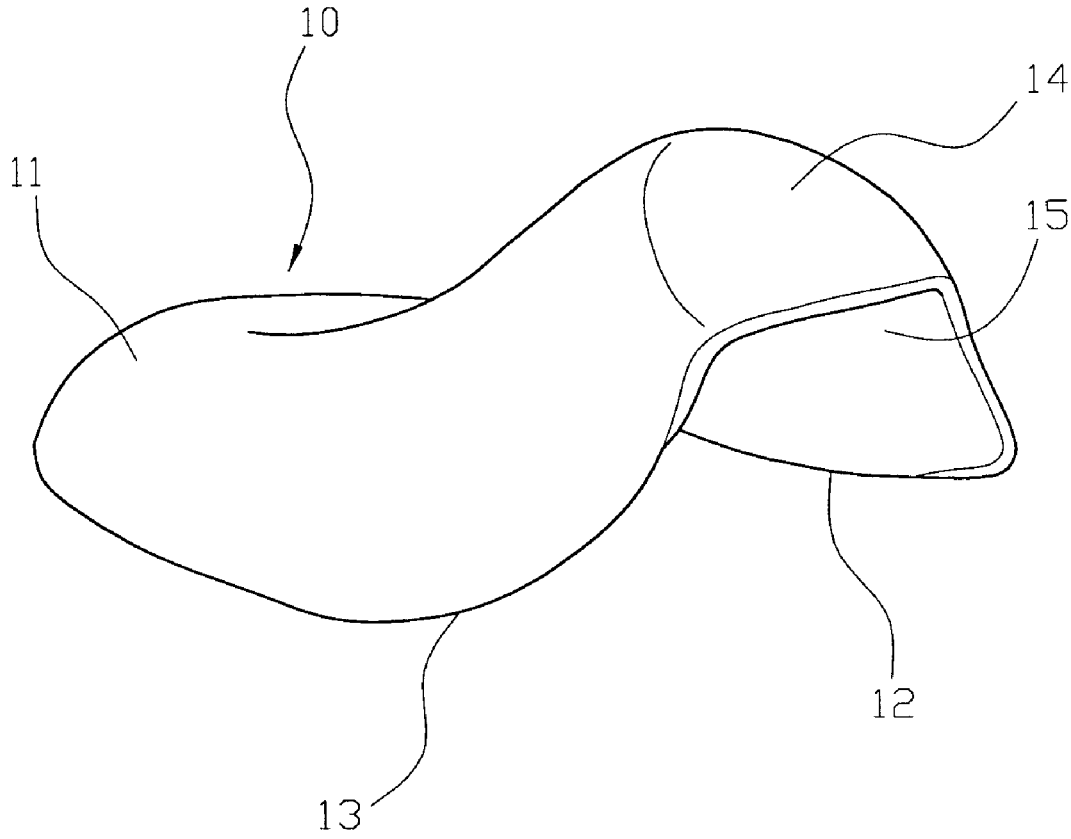
FIG. 6 is a perspective view of a shoe tree in accordance with another preferred embodiment of the present invention.
Figure 7:
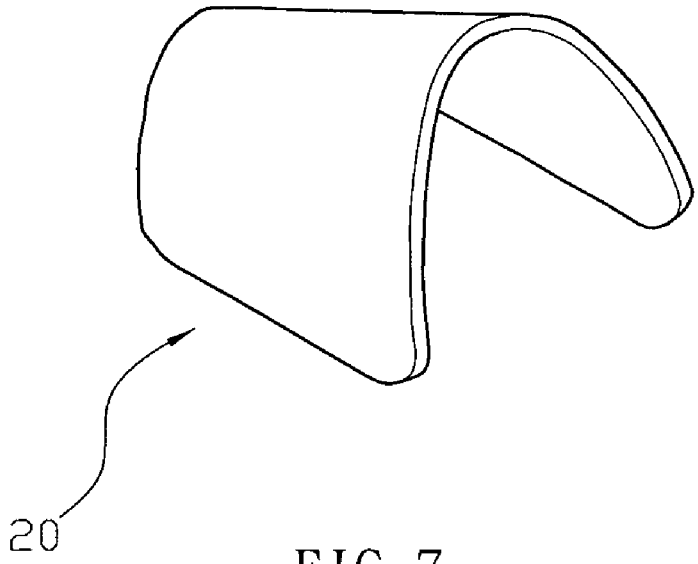
FIG. 7 PRIOR ART
FIG. 7 is a perspective view of a conventional shoe tree in accordance with the prior art.
Figure 8:
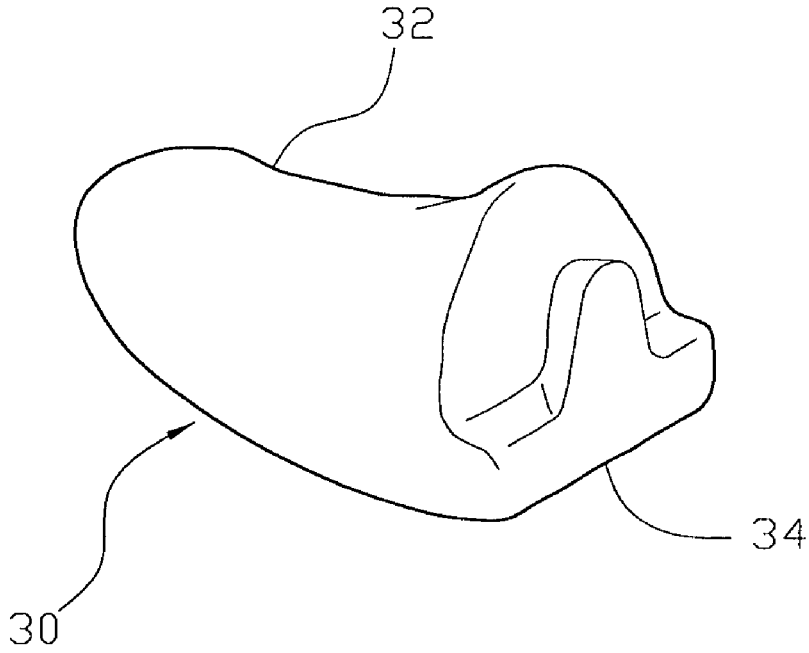
FIG. 8 PRIOR ART
FIG. 8 is a perspective view of another conventional shoe tree in accordance with the prior art.
Figure 9:
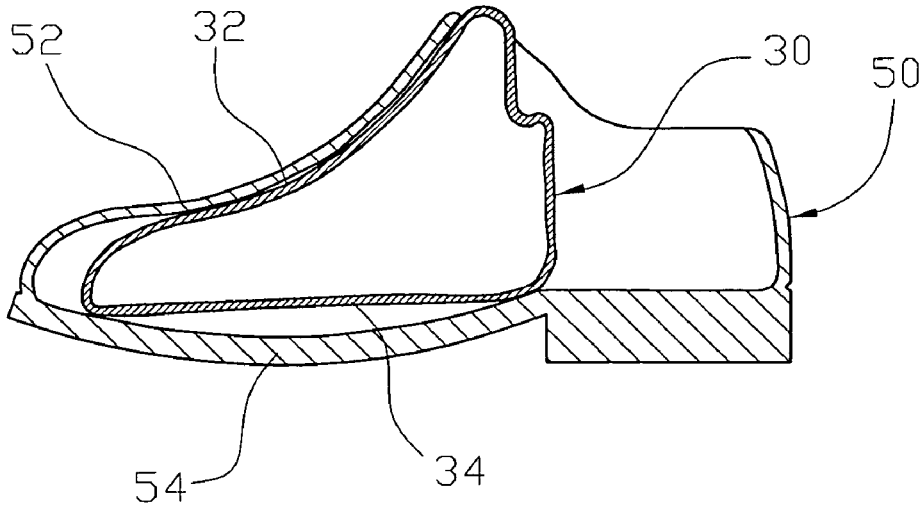
FIG. 9 PRIOR ART
FIG. 9 is a side plan cross-sectional view of the conventional shoe tree for one shoe as shown in FIG. 8.
Figure 10:
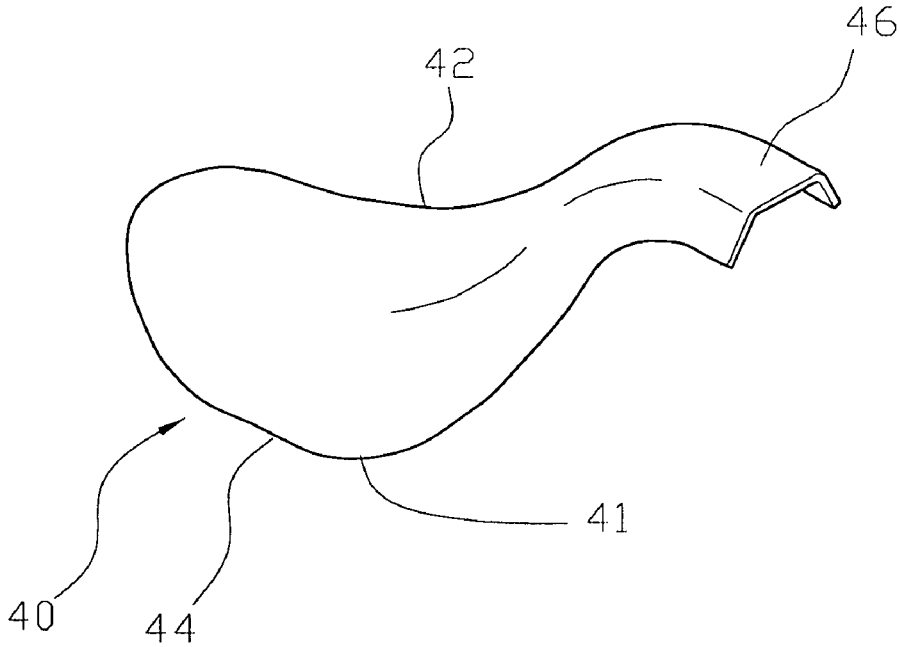
FIG. 10 PRIOR ART
FIG. 10 is a perspective view of another conventional shoe tree in accordance with the prior art.
Figure 11:
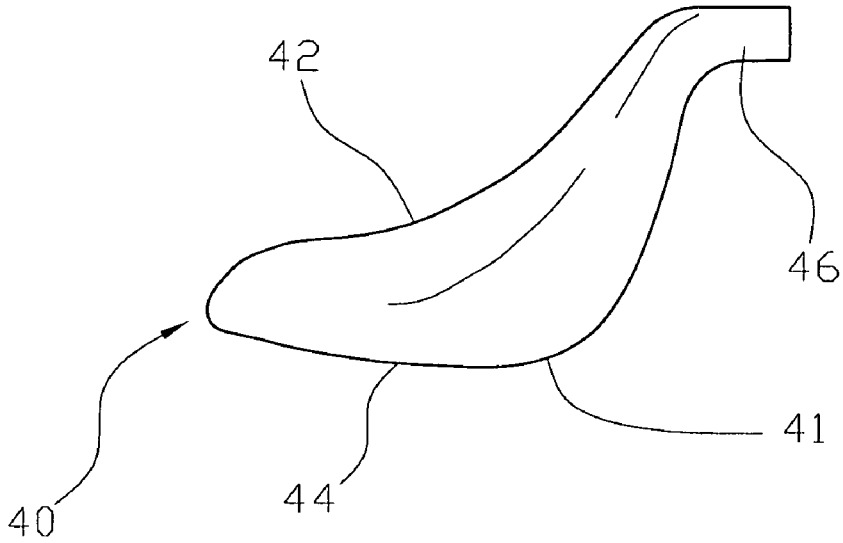
FIG. 11 PRIOR ART
FIG. 11 is a plan view of the conventional shoe tree as shown in FIG. 10.
Figure 12:
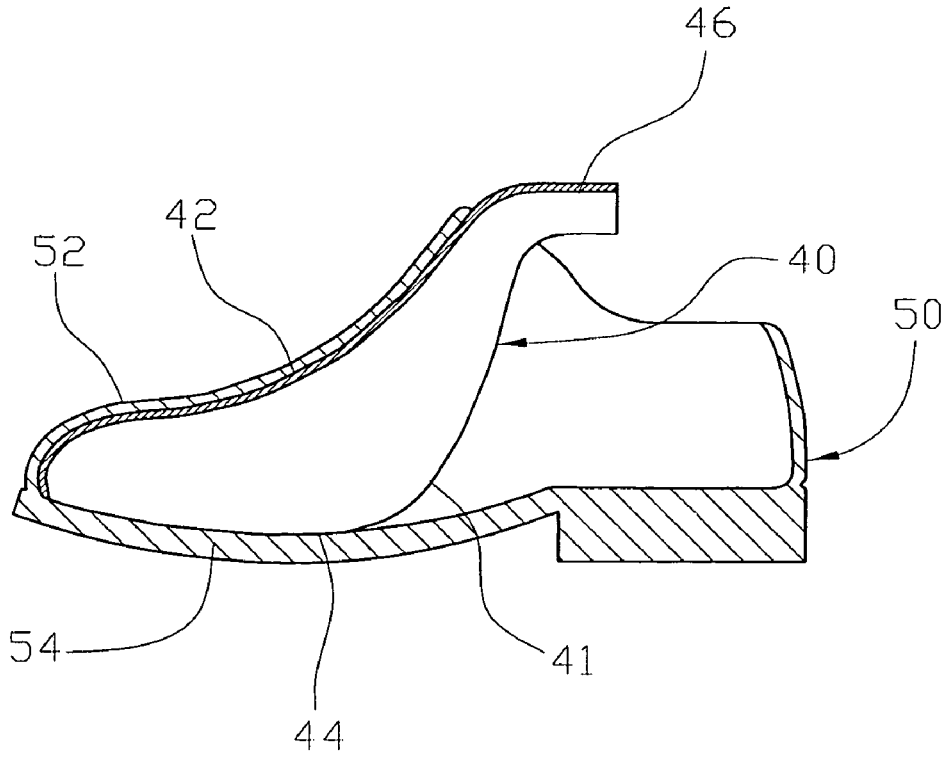
FIG. 12 PRIOR ART
FIG. 12 is a side plan cross-sectional view of the conventional shoe tree for one shoe as shown in FIG. 10.

As shown in FIG. 6, the rising portion 14 of the main body 10 has a flattened shaped and has a bottom formed with a recessed hollow portion 15 connected to an inside of the main body 10 to allow insertion of a user's one finger into the inside of the main body 10.

Accordingly, the first side support portion 12 has a shape matching that of the outer side of the shoe "A", and the second side support portion 13 has a shape matching that of the inner side of the shoe "A" so as to satisfy the ergonomic design, so that the inner space of the shoe "A" is supported by the main body 10 of the shoe tree rigidly and stably, thereby preventing the shoe "A" from being deformed due to its gravity. In addition, the rising portion 14 of the main body 10 has a bottom formed with a hollow portion 15 connected to the inside of the main body 10 to allow insertion of a user's one finger into the inside of the main body 10, so that the main body 10 is removed from the shoe "A" easily and rapidly, thereby facilitating the user removing the shoe tree from the shoe "A".

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A shoe tree, comprising a main body having a front end formed with a vamp support portion and a rear end formed with an upwardly extending rising portion and having a first side formed with a substantially arc-shaped first side support portion and a second side formed with a substantially arc-shaped second side support portion extending forward relative to the first side support portion;

wherein the first side support portion and the second side support portion of the main body are arranged in an asymmetric manner;

the second side support portion is extended rearward and downward from the vamp support portion, and the first side support portion is extended rearward and downward from the vamp support portion;

the first side support portion is extended to an extent exceeding the second side support portion so that the first side support portion is protruded outward from the second side support portion;

the first side support portion is located in rear of the second side support portion;

the first side support portion and the second side support portion of the main body are located at different heights;

the second side support portion of the main body is located at a height greater than that of the first side support portion of the main body;

the second side support portion of the main body has a curvature smaller than that of the first side support portion of the main body.

2. The shoe tree in accordance with claim 1, wherein the rising portion is substantially arc-shaped and has a smooth outer face.

3. The shoe tree in accordance with claim 1, wherein the rising portion is extended upward in a curved manner from a curved face of each of the first side support portion and the second side support portion.

4. The shoe tree in accordance with claim 1, wherein the rising portion has a rear side extended rearward and downward and has a convex protruding face located between the first side support portion and the second side support portion.

5. The shoe tree in accordance with claim 4, wherein the rear side of the rising portion has a bottom formed with a hollow portion connected to an inside of the main body and connected to the first side support portion and the second side support portion to allow insertion of a user's one finger into the inside of the main body.

6. The shoe tree in accordance with claim 1, wherein the rising portion of the main body has a top having a transversely flattened shaped and has a bottom formed with a recessed hollow portion connected to an inside of the main body and connected to the first side support portion and the second side support portion to allow insertion of a user's one finger into the inside of the main body.

7. The shoe tree in accordance with claim 1, wherein the main body is a hollow shell shaped element that is formed integrally.

* * * * *